United States Patent [19]

Lee

[11] 4,062,080

[45] * Dec. 13, 1977

[54] FEEDING DEVICE FOR HIGH SPEED NUT FORMERS

[76] Inventor: Yuan Ho Lee, 85, Gen Ho Road, Tainan, China /Taiwan

[ * ] Notice: The portion of the term of this patent subsequent to Apr. 19, 1994, has been disclaimed.

[21] Appl. No.: 739,869

[22] Filed: Nov. 9, 1976

[51] Int. Cl.[2] ..... B21D 53/24

[52] U.S. Cl. ..... 10/76 T

[58] Field of Search ..... 10/11 T, 12 T, 72 T, 10/76 T, 162 R, 166, 172

[56] References Cited

U.S. PATENT DOCUMENTS

| | | | |
|---|---|---|---|
| 729,822 | 6/1903 | Wetmore | 10/72 T |
| 1,899,221 | 2/1933 | Ward et al. | 10/72 T |
| 2,058,698 | 10/1936 | Lehman | 10/12 T |
| 3,022,526 | 2/1962 | Davis et al. | 10/12 T |
| 3,274,626 | 9/1966 | Van de Meerendonk | 10/76 T |
| 3,488,784 | 1/1970 | Hatebur | 10/76 T |
| 3,533,115 | 10/1970 | Van de Meerendonk | 10/76 T |
| 3,717,890 | 2/1973 | Weller | 10/12 T |

*Primary Examiner*—E. M. Combs

*Attorney, Agent, or Firm*—Lane, Aitken, Dunner & Biems

[57] ABSTRACT

A feeding device for high speed nut formers and more particularly a feeding device whereby blanks are fed along a guide way in a series of short linear transfer operations and are positioned in front of die stations in sequence by means of a transfer mechanism capable of transferring said blanks linearly along a straight guide way and returning along an arcuate path.

4 Claims, 4 Drawing Figures

FEEDING DEVICE FOR HIGH SPEED NUT FORMERS

BACKGROUND OF THE INVENTION

The present invention relates to improvements in feeding devices for high speed nut formers such as disclosed in co-pending application no. 644,942 filed Dec. 29, 1975 by the present inventor, now U.S. Pat. No. 4,014,058.

As stated in said co-pending application, the major defects of conventional devices for the transfer of blanks to various die stations is that, firstly, it is necessary for the cutting device to transfer the cut blank from a cutting die to the first die station, generally impeding the speed of the cutting operation. Secondly, blanks are transferred between die stations by transfer fingers or arms along an arcuate path away from and back to the face of the die assembly so that the ram carrying the punch assembly must return along this same arched path to its original die station before transferring another blank. It is also necessary for said transfer arms to have a dwell interval in order to "wait" for the ram to retreat from the dies. These transfer arms often reverse or turn the blank over 180° during transfer. In any case, it is obvious that in addition to the long path of transfer the slow cutting speed and long stroke of the ram are also obstructions to high speed operation. Such devices may be seen in U.S. Pat. Nos. 3,069,917; 3,259,929; 3,717,890 and others.

Other transfer devices not employing transfer arms employ feeding plates or bars to transfer blanks directly from one die to the next. This transfer path is still very long and necessitates a dwell in the punching operation. These devices are seldom used today as it is not possible to effect the turning over of blanks which is necessary to insure proper facing. Such devices may be seen in U.S. Pat. Nos. 3,274,626; 3,533,115; 3,604,242 and others.

In the above said co-pending application the present inventor has eliminated all of the above defects by providing a feeding device wherein the distance of each transfer is at least one-fourth the distance of conventional devices which transfer directly from die to die, greatly reducing the length of the stroke of the main ram, while the mass of the transfer apparatus is also greatly decreased. Therefor it is possible to increase production rates by at least four times.

The primary object of the present invention is to provide an improvement on the transfer mechanism of the above said application so that suitable pressure is applied to each blank in the feed path and accurate positioning of each blank is assured.

Another object of the present invention is to provide an improvement on the transfer mechanism of said application so that misaligned nuts or other obstructions in the guide path will not cause damage to the transfer mechanism.

A further object of the present invention is to provide an improvement in the arrangement and coaction of the transfer mechanism and the guide path of said application so as to achieve the smoothest possible transfer operation and to provide easy and quick installation and set-up operations.

BRIEF DESCRIPTION OF THE DRAWINGS

Other purposes and advantages of the present invention will be apparent as a preferred embodiment thereof is described with reference to the appended drawings wherein.

DETAILED DESCRIPTION OF THE DRAWINGS

Figure 1:
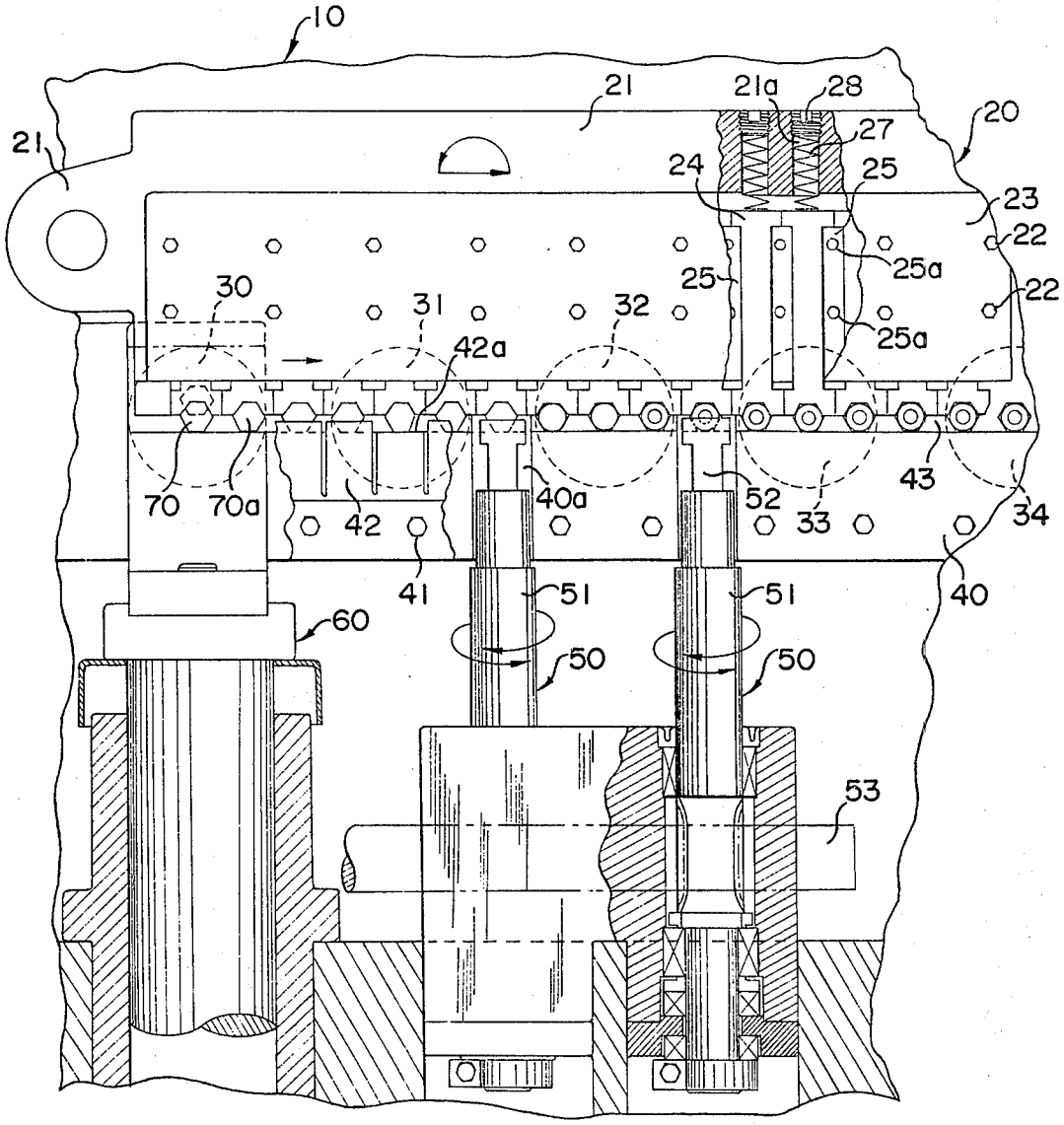
FIG. 1 is an assembly elevation of a preferred embodiment according to the present invention.
Figure 2:
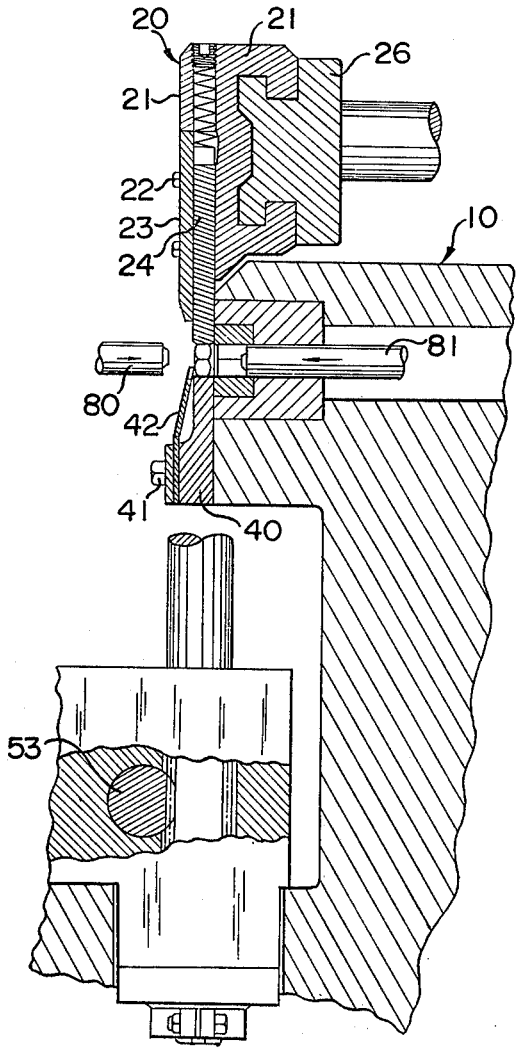
FIG. 2 is a sectional view thereof.

As shown in the drawings, a transfer mechanism 20 capable of advancing linearly along a straight path and then returning upwardly and downwardly to its original position along the locus of a suitable arcuate path is provided on a machine body 10. Also provided on the face of said machine body 10 is a cutting die 30, first, second, and third forming dies 31, 32 and 33 respectively, and a final piercing die 34. A guide plate 40 is secured to the machine body 10 along a line connecting the bottommost points of the cavity of each die. Secured to the face of the guide plate 40 by means of bolts 41–41 is a resilient pressure plate 42 so that a linear feeding path 43 is formed along the face of the dies.

The transfer mechanism 20 is provided with a sliding plate 21 which is slidably mounted on a sliding base 26. Said sliding base 26 moves upwardly and downwardly in response to a cam controlled manipulating device (not shown). Said sliding plate 21 is caused to slide in a linear reciprocating motion on the sliding base 26 by means of a separate cam controlled manipulating mechanism (not shown). The combined vertical and horizontal movements of the sliding base 26 and the sliding plate 21 cause the transfer mechanism 20 to advance along a straight path for a specified distance, and then to return to its original position along an upwardly then downwardly arcuate path of travel as shown by the uppermost arrows in FIG. 1.

Figure 3:
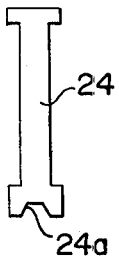
FIG. 3 is a plan view of a transfer tab thereof.

Along the front end of the sliding plate 21 are secured a plurality of equally spaced apart guide rails 25–25. Between each two successive guide rails 25 is disposed a transfer tab 24 being generally I-shaped, as shown in FIG. 3, with the upper portion thereof being supported by said two successive guide rails and the lower portion thereof having an indentation **24*a* in the general configuration of one half the outside shape of a nut blank. The straight sides of the I-shaped transfer tabs are somewhat longer than the adjacent guide rails 25 so that the transfer tabs 24 will enjoy a suitable amount of sliding freedom upwardly and downwardly therebetween. Each transfer tab 24 is urged downwardly by a spring 27 disposed in a spring receiving bore 21*a* provided in the sliding plate 21 for this purpose, each said spring 27 being mounted therein and secured by means of a sunken head screw 28 or the like. Threaded holes 25*a* are provided in the guide rails 25 for the purpose of securing a cover plate 23 thereover by means of machine screws 22** to form a resilient and efficient transfer device.

Figure 4:
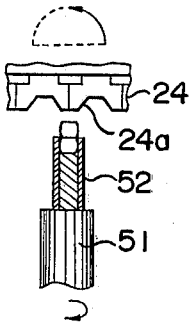
FIG. 4 is a view in partial section showing cooperating operations of the transfer mechanism and a turnover device thereof.

As shown in FIG. 1, the pressure plate 42 is cut away at the central position before each die station so that the plate is even with the guide plate 40, as shown at **42*a*, to facilitate punching by punches 80 provided on a main ram (not shown). In addition, when employing a rotational turnover device as disclosed in co-pending application no. 645,078 by the present inventor, now U.S. Pat. No. 4,017,928, the guide plate 40 may include an interruption or space 40a between any two stations to accommodate a rotary shaft 51 of the turnover device 50 which includes a gripping means 52 for gripping nuts fed thereto by means of the transfer device and a rack 53 for rotating the shaft 51 180° on its axis to effect turnover of the said blank as the transfer mechanism returns as shown in FIG. 4**.

During operation, a nut blank 70 is cut from a wire-stock supply (not shown) by a suitable cutting device 60 as it is fed through a cutting die 30. After cutting, the blank 70 is introduced into the feeding path 43. As the transfer mechanism 20 causes the transfer tabs 24–24 enter the feeding path 43 from above the indentation 24a of the first of the transfer tabs 24–24 in succession will mesh with the blank 70 and as the transfer mechanism 20 advances in a straight linear path the blank 70 will be conveyed to the position 70a of the preceding blank in succession in the direction of the arrow indicated above the feeding path in FIG. 1. When the blank 70 has attained the position indicated at 70a will be gripped by the second transfer tab 24 in succession and transferred a distance equal to the distance of the first transfer. According to the present embodiment, four short advancing motions of the transfer mechanism 20 will be required to transfer the blank 70 from the center of the cutting die 30 to a central position in front of the first die station 31.

Each time the transfer mechanism 20 completes a transfer motion, a punch 80 will feed a blank to a die as an ejector pin 81 provides support to the blank. As the punch 80 retreats the pin 81 advances and ejects the blank into the feeding path 43, whereupon the transfer mechanism 20 returns to the feeding path 43, transferring the blank a short distance to the position of the preceding blank in succession prior to transfer.

In machines of this type a finished product is produced with every stroke of the ram. By decreasing the total distance of every transfer operation and likewise decreasing the stroke of the ram the number of punching operations and hence, the number of finished products, produced per minute may be greatly increased. Therefore, by providing a transfer device capable of transferring nut blanks between dies in very short transfer motions, the total speed of the nut forming operation is greatly enhanced. In addition, by providing such a device with spring mounted transfer tabs each tab will be gripped with uniform pressure, regardless of slight variation in size of the individual blanks. In addition, due to the spring mountings, misaligned blanks will cause no damage to the transfer tabs or transfer mechanism in general.

What I claim is:

1. A blank transferring device for a high speed nut forming machine having a machine body on which a plurality of dies having central cavities for receiving blanks are mounted along a straight line defined by the respective center points of said dies comprising:

a manipulating mechanism provided on said machine body and adapted to provide advancing motion along a straight line and returning motion along an arched path;

a guide plate provided on said machine body along a line defined by the respective lowest points of said cavities of the dies;

a resilient pressure plate provided on said guide plate and extending a suitable distance beyond the line defined by the respective lowest points of said cavities of the dies, said pressure plate cooperating with the face of the machine body on which the plurality of dies are mounted to define a feed path;

a transfer mechanism having a sliding plate suitably supported by at least one guide rail and a plurality of juxtapositioned spring mounted tabs disposed on said sliding plate, each tab having an indentation of a suitable shape to hold and convey blanks positioned along the feeding path between the pressure plate and said face of the machine body, the distance between the centers of the indentations of adjacent tabs being a suitable fraction of the distance between two successive dies, the transfer mechanism being operatively connected to the manipulating mechanism and adapted to have the tabs thereof movably and removably positioned in the feed path;

thereby to successively hold, convey, and release blanks in said feed path due to alternating advancing straight line and returning arched path motions provided by the manipulating mechanism so that blanks are moved along said feed path in a plurality of discrete steps from one die to the next successive die.

2. A blank transferring device according to claim 1 wherein each tab is in the general configuration of an "I" having the indentation provided in the lower end, the upper T-portion resting on suitable guide rails provided on the transferring mechanism for that purpose, said guide rails being of a suitably shorter length that the tab.

3. A blank transferring device according to claim 2 wherein each tab is provided between two guide rails of suitable length, the upper portion of said tab being larger than the distance between said two guide rails and being biased by a suitable spring to be in contact with said guide rails, each said spring being provided in a suitable cavity in said transferring mechanism and suitably secured therein.

4. A blank transferring device according to claim 1, further including at least one rotary turn over device provided between two adjacent dies for the purpose of turning over blanks, said device having blank gripping means and which is capable of turning over blanks fed thereinto by the operation of said transferring mechanism by rotating 180° on its axis.

* * * * *